United States Patent [19]

Karlan

[11] 3,942,621

[45] Mar. 9, 1976

[54] METHOD OF AND ARTICLE FOR MASKING

[76] Inventor: Mac Karlan, 1700 Grand Concourse, Bronx, N.Y. 10457

[22] Filed: Apr. 28, 1970

[21] Appl. No.: 32,574

[52] U.S. Cl. ..... 197/181; 427/140

[51] Int. Cl.[2] ..... B41J 29/16

[58] Field of Search ..... 197/172, 181; 117/3.1, 117/3.5, 3.6, 36.1, 2, 2 TC; 156/240; 106/19, 20, 22, 23, 300, 305, 307

[56] References Cited

UNITED STATES PATENTS

| | | | |
|---|---|---|---|
| 1,817,522 | 8/1931 | Price | 197/172 UX |
| 1,843,738 | 2/1932 | Schubert | 197/172 UX |
| 1,939,821 | 12/1933 | Lawrence | 197/172 UX |
| 2,191,947 | 2/1940 | Allen et al. | 106/300 UX |
| 2,755,202 | 7/1956 | Balon et al. | 197/172 X |
| 2,767,650 | 10/1956 | Yunker et al. | 197/181 |
| 2,836,152 | 5/1958 | Rosenblum | 197/181 X |
| 3,013,917 | 12/1961 | Karlan et al. | 156/240 X |
| 3,065,120 | 11/1962 | Avelar | 156/240 X |
| 3,114,447 | 12/1963 | Wolowitz | 197/181 X |
| 3,225,888 | 12/1965 | Javors | 197/172 X |
| 3,297,507 | 1/1967 | Twomey | 156/240 |
| 3,298,850 | 1/1967 | Reed et al. | 117/3.1 |
| 3,410,251 | 11/1968 | Glenn et al. | 197/181 X |
| 3,459,127 | 8/1969 | Barouh | 197/181 X |
| 3,515,572 | 6/1970 | Dabisch | 117/2 X |
| 3,519,456 | 7/1970 | Reed et al. | 156/240 X |

FOREIGN PATENTS OR APPLICATIONS

| | | | |
|---|---|---|---|
| 816,022 | 6/1969 | Canada | 117/3.1 |
| 932,937 | 7/1963 | United Kingdom | 197/172 |

OTHER PUBLICATIONS

American Ink Maker, Jan. 1946, pp. 23–26.
American Ink Maker, Mar. 1950, pp. 29–32, 63.
American Ink Maker, Apr. 1950, pp. 27–29, 53, 55.

*Primary Examiner*—Ernest T. Wright, Jr.
*Attorney, Agent, or Firm*—Armand E. Lackenbach

[57] ABSTRACT

Pellucid carrier sheet having opaque coherent film masking elements releasably secured on the rear surface and pressure responsive means on the rear surface of such elements for enabling transfer thereof through pressure application, as by rubbing with a stylus, to mask and cover errors, or the like, for correction and methods of use thereof.

1 Claim, 8 Drawing Figures

FIG. 1
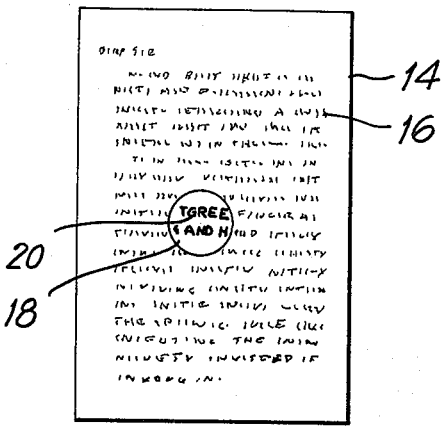
FIG. 2
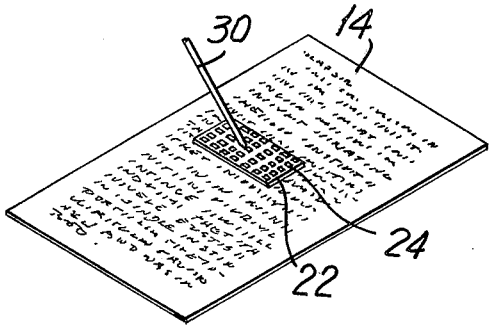
FIG. 3
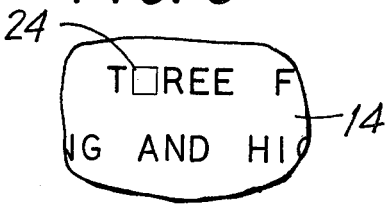
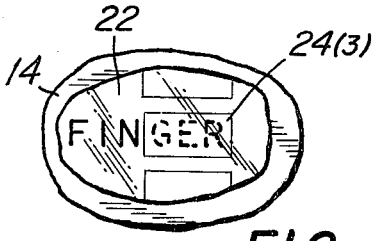
FIG. 5
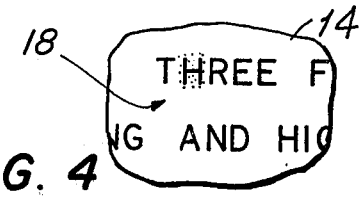
FIG. 4
FIG. 6
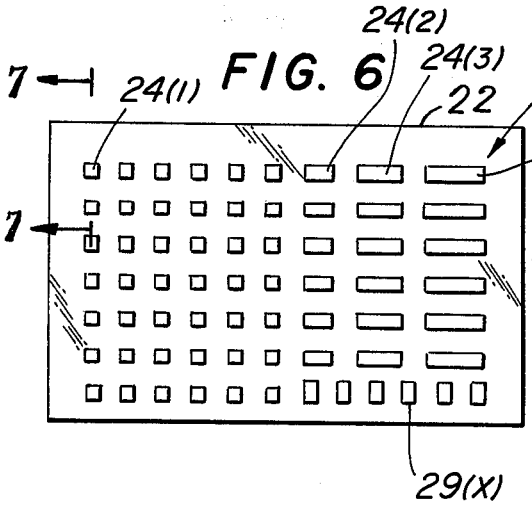
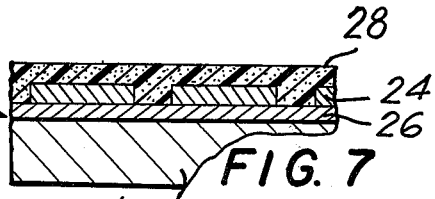
FIG. 7
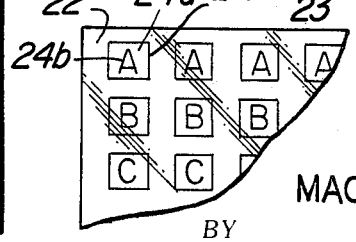
FIG. 8
INVENTOR.
MAC KARLAN
BY
ATTORNEYS

METHOD OF AND ARTICLE FOR MASKING

This invention relates to the graphic arts and, more particularly, to masking, as to enable correction and/or modification, of, for example, typewritten material.

Various methods and means have heretofore been suggested for use in the graphic arts for effecting changes and corrections. For many purposes, it is necessary that changes be made by physically removing the old material, as by the abrasive action of erasers, or by means of chemical action, such as the bleaching action of ink eradicators. In many instances, however, it is sufficient if the material desired to be changed merely be rendered non-visible to an observer, as by covering the portion or area to be changed with an opaque substance which optically matches the tone and color of the underlying material. Such covering or masking has heretofore been accomplished either by the application of a liquid, as by means of a brush, or, particularly in the case of typewritten material, by means of a pressure transferable opaque substance coated on a carrier sheet. Materials of the first type are commercially available under the trademark "SNO PAKE" while materials of the second type are sold under the trademark "KO-REC-TYPE" and are further described, for example, in U.S. Pat. No. 3,459,127.

Such correction materials as have been heretofore available, however, have not been entirely satisfactory, particularly in connection with the correction of typewritten materials. The liquid type correction materials are somewhat messy to utilize, entail some delay while waiting for the material to dry before the correction can be completed and/or require the regular addition of highly volatile solvents to maintain the proper consistency. The pressure transfer type of correction materials heretofore available, as set forth above, while eliminating some of the disadvantages of the liquid type, such as eliminating the necessity for handling volatile solvents and any drying or waiting time, are themselves not entirely satisfactory, although for reasons which differ from those which render the liquid type materials somewhat unsatisfactory. In using such dry correction materials as have been heretofore available, such as the aforementioned KO-REC-TYPE, the correction material is positioned over the typewritten error and the erroneous character re-struck, to transfer a pressure transferable coating from the correction material to the paper to thereby cover the incorrect character. Hence, it is imperative that the alignment of the erroneous character with the typewriter be exact, a situation which is difficult, if not impossible to achieve if the paper has been removed from the typewriter carriage or, under certain conditions, even if several additional lines have been typed prior to attempting to make the correction. In addition, the pressure transferable coating of the prior materials have been substantially powderlike and very easily transferred, as by inadvertent contact thereof, even with the typist's hands or fingers, resulting in occasional incomplete coverage of the erroneous character as well as providing a source of dirt and dissatisfaction to the typist.

Having in mind the foregoing, it is a primary object of the present invention to provide novel and improved methods and apparatus for use in the graphic arts to enable the making of corrections.

Another primary object of the present invention, in addition to the foregoing, is the provision of novel and improved methods and apparatus for the making of corrections in the graphic arts which are clean, safe, effective, efficient and entail substantially no time delay.

Yet another primary object of the present invention, in addition to each of the foregoing objects, is the provision of novel and improved methods and apparatus for the making of corrections which may be utilized, for example, for typewritten material whether out of or in the typewriter but which is yet dry so as to not entail spillage, drippage, volatile solvents or any drying period and which will yet not inadvertently rub off or transfer.

Another and yet still further primary object of the present invention, in addition to each of the foregoing objects, is the provision of methods of correction for use in the graphic arts and, particularly, for the correction of typewritten material, which is simple and effective, whether performed in or out of the typewriter.

Yet still another primary object of the present invention, in addition to each of the foregoing objects, is the provision of novel and improved apparatus for enabling correction for use in the graphic arts, and particularly for the correction of typewritten material which is economical to manufacture while being yet clean, simple, easy and effective in use.

The invention resides in the combination, construction, arrangement and disposition of the various component parts and elements incorporated in improved methods and apparatus for enabling correction in accordance with the principles of this invention. The present invention will be better understood and objects and important features other than those specifically enumerated above will become apparent when consideration is given to the following details and description, which when taken in conjunction with the annexed drawing describes, discloses, illustrates and shows a preferred embodiment or modification of the present invention and what is presently considered and believed to be the best mode of practicing the principles thereof. Other embodiments or modifications may be suggested to those having the benefit of the teachings herein, and such other embodiments or modifications are intended to be reserved especially as they fall within the scope and spirit of the subjoined claims.

IN THE DRAWING

FIG. 1 is a plan view of an exemplary piece of graphic arts material and particularly a typewritten letter having an error, specifically a misspelling of the word "THREE";

FIG. 2 is an illustration of the misspelled letter of FIG. 1 being corrected by having the incorrect character thereof masked in accordance with the present invention;

FIG. 3 is an enlarged illustration of the corrected region showing the incorrect character masked in accordance with the present invention and ready to have the correct character inserted or struck thereon;

FIG. 4 is an illustration similar to FIG. 3 showing the completed correction;

FIG. 5 is an illustration similar to FIG. 3 showing the masking of a plurality of characters simultaneously in accordance with the present invention;

FIG. 6 is a plan view of an article of manufacture viewed from the bottom or transfer side thereof embodying correction apparatus in accordance with the present invention;

FIG. 7 is an enlarged cross-sectional view taken along section line 7—7 FIG. 6; and FIG. 8 is a partial plan view of another article of manufacture embodying correction apparatus in accordance with the present invention.

With reference now to the drawing, there is shown and illustrated a sample of graphic arts material, such as a sheet of paper 14 having written material 16 provided on one surface thereof, as by means of typewriting, or the like. The written material 16 as typed, contains a region 18 which contains an erroneous character 20, the exemplary error comprising a misspelling of the word "THREE" with the desired "H" thereof having been erroneously inscribed as a "G".

Heretofore, three basic methods of correction have been available; erasure, covering of the incorrect character with an opaque correction material which was applied, as by means of a brush while in a liquid state and then allowed to dry or by utilizing a typewriter correction material such as that sold under the trade name KO-REC-TYPE which comprises a paper-like sheet of material having a powdery opaque substance on the reverse side thereof and which may be positioned over the incorrect character which is then restruck with the typewriter to transfer the powdery substance to cover the incorrect character, the correction material being similar to conventional single-use carbon paper except that the coating is selected to blend into, rather than contrast with the color of the sheet being corrected. Each of these various prior methods, however, have been objectionable and to some extent unsatisfactory, for a number of reasons. Physical erasure is time consuming, particularly when a number of copies need correction, the erasure particles produced interfere with the proper action of the typewriter, often results in tearing of the paper, and generally results in an unattractive appearance. The physical forces involved also often result in slippage of the paper on the typewriter carriage and misalignment of succeeding typewritten characters. The utilization of a correction fluid generally results in a better appearance but, the time required to make a correction is still substantial, the liquid material is messy to handle and use, and difficulty is experienced by many people in limiting the application of the correction fluid to the small area desired. The fluid, moreover, upon drying generally has a more glossy appearance than the surrounding paper and is therefore more obvious than may be desired. The utilization of correction paper has received very wide acceptance since this method is generally faster, cleaner and provides a better appearance than either physical erasure or utilization of correction fluid. However, since it requires that the erroneous character be exactly re-struck with the correction paper interpositioned over the paper, this method is only suitable while the paper is still in the typewriter, in its original orientation and, preferably, before many additional words or lines have been typed. Hence, this system is generally unavailable where the paper has been removed from the typewriter. Secondly, since the coating is a particulate one, it is generally ineffective for completely masking heavily inked characters. Further, where a large pluralities of copies have been made, the softness of the stack of paper generally has resulted in a slightly larger ink character which cannot be completely covered by the correction material. Yet further, while the correction material is generally cleaner to work with than the previous methods, some mess and inadvertent ruboff may occur.

In accordance with the present invention, however, there is provided as an article of manufacture a correction sheet designated generally by the reference character 22 comprising a carrier sheet 23 on which there are provided a plurality of masking elements 24 adapted to be positioned in superposition generally covering an erroneously typed character or other graphical material which are constructed and arranged to enable selective transfer of the masking elements 24 from the correction sheet 22 to the sheet of paper 14 or other surface to mask or cover an incorrect character or other character or graphic material which it is desired to delete or change, and enable a correct character to be applied on the surface thereof, as by being typed, hand lettered, transferred from a dry transfer sheet, or the like.

The carrier sheet 23 is preferably pellucid so as to enable the masking elements 24 to be visually positioned as desired over the region of the sheet of paper 14 to be masked, covered or corrected thereby. A large variety of materials are suitable for the carrier sheet 23 which may comprise greaseproof papers or films such as, for example, and without limitation, vellums, transparent papers, translucent papers, polyethylene, polystyrene, polypropylene, and the like. It has been found that the paper or film utilized to form the carrier sheet 23 preferably should not be calandered, it being believed that calandering leaves a residue of gloss on the adjacent surface of the masking element 24 which, for use with most papers, which are uncoated, is undesirable. For some papers, notably coated papers, it may be desirable to use a calandered carrier sheet 23 so that the masking elements 24 will have a higher gloss.

The masking elements 24 may comprise an ink or paint, such as a flat silkscreen paint or a highly pigmented varnish which should be of such a tensile strength that upon drying the ink or paint dries as a coherent film and may be applied to the carrier sheet 23, for example, by silkscreen printing techniques. Where the masking elements 24 are particularly adapted for use in the making of typewriter corrections, the masking elements 24 should have sufficient opacity and color retention to match the color, texture and appearance, as close as possible, of typewriter or Bond paper. It has been found that a suitable composition, which has the above characteristics, including opacity, color match to Bond typewriter paper, tensility and which will retain its whiteness and be nonyellowing comprises adding to, for example, one gallon of flat white silkscreen paint, one-half ounce ultramarine blue printing ink toner dispersed in a flating oil, such as marketed by National Lead Company, one-half ounce Japan black dispersed in a small amount of turpentine, followed by thorough mixing. It has also been found that greater opacity and covering power can be provided by milling one-half pound titanium dioxide into the basic white paint.

Suitable silkscreen paints are commercially available for use in the present invention with the addition of the substances as set forth above and one commercially available paint which has been found suitable is a white screen process ink sold under the trade name of SPEED PRINT and having a composition as follows:

| | |
|---|---|
| Pigment by Weight | 45% |
| Vehicle by Weight | 55% |
| | 100% |
| Composition of Pigment by Weight: | |
| Titanium Dioxide | 69% |
| Silicates | 22% |
| Calcium Carbonate | 9% |
| | 100% |
| Composition of Vehicle by Weight: | |
| *Varnish | 54% |
| **Cellulose Resin Solution | 9% |
| Aromatic Hydrocarbons | 23% |
| Aliphatic Hydrocarbons | 14% |
| | 100% |
| *Non-Volatile | |
| Phenolic Ester Gum, Linseed, Oiticia, Tung | 40% |
| Volatile | |
| Aromatic Hydrocarbons | 60% |
| | 100% |
| **Non-Volatile | |
| Ethyl Cellulose Resin | 50% |
| Volatile | |
| Aromatic Hydrocarbons | 50% |
| | 100% |

Between the marking elements 24 and the carrier sheet 23, there may be provided a release coating 26 which may comprise a polysiloxane or a chrome complex such as is marketed by duPont Corporation under the trademark "QUILON". QUILON is furnished by duPont as a 30% chrome complex and it has been found that this can be reduced by mixing with isopropyl alcohol in a 5-to-1 ratio to provide a 6% solution which is then applied to the carrier sheet 23 if the carrier sheet 23 is paper. The plastic films, if utilized as a carrier sheet 23, have sufficient release characteristics as to not require the release coating 26. Finally, an adhesive layer 28 which may comprise, for example, a microcrystalline wax may be applied over the masking elements 24 to enable transfer and adherence of the masking elements 24 from the correction sheet 22 to the typewritten sheet 14. As heretofore pointed out, the masking elements 24 may be applied to the carrier sheet 22 by means of silkscreen printing techniques. A fairly open mesh silkscreen should be used to maintain a high buildup of ink and to aid in obtaining sufficient opacity and tensility. Silkscreen meshes between the aproximate range of 166 to 230 mesh have been found to be suitable. This range of meshes is permissible when using the various methods of films or emulsions in preparing the silkscreen plate or stencil. The thicker the film or emulsion, the higher the mesh number. In the present application, it has been found that a masking element thickness of approximately 1 ½ mils is appropriate to maintain the desired opacity and tensility.

For further details of the manufacture and composition, reference is hereby made to U.S. Pat. No. 3,013,917 dated Dec. 19, 1961 and to my co-pending U.S. application Ser. No. 587,751 filed Oct. 19, 1966, the entire disclosures of which are hereby expressly incorporated herein by reference as fully and completely as if physically reproduced herein.

In use, the correction sheet 22 may be positioned with one of the masking elements 24 overlying the incorrectly typed letter or character and force applied to the opposite surface of the carrier sheet 23, as by rubbing the surface thereof with a stylus 30 or other instrument such as a ballpoint pen, a pencil, a paper clip, a fingernail, or the like, to transfer the masking elements 24 from the correction sheet 22 into overlying, covering and blanking relationship adhered to the typewriter paper sheet 14 as illustrated in FIG. 3 and, then, the correct character may be inserted, as by typing or as a transfer from a sheet such as that described and disclosed in U.S. Pat. No. 3,013,917 configured and colored to match the typewriter font and inking. Hence, the correction may be made either while the sheet 14 is still in the typewriter or may be made after removal of the sheet 14 from the typewriter carriage. If desired, the masking element 24 may, as shown, for example, in FIG. 8, define a composite element designated 24' which may comprise two portions, a blanking or opaquing portion **24*a* of sufficient dimensional extent to cover and effect deletion of a previously typed character and a portion 24b defining the desired replacement character having a color and texture similar to that of a typewritten character so that in a single operation, the element 24' may be transferred to the typewritten sheet 14 to simultaneously cover the typewritten character already thereat and provide a corrected character in its place and stead, as illustrated in FIG. 4**.

As an aid in providing matching of texture with the typewritten characters, the dry transfer character should also be flat or non-glossy, as by being printed on an uncalendered paper carrier.

The masking element 24 illustrated in FIG. 3 may be configured so as to mask and cover a single typewritten letter as illustrated in FIG. 3. Preferably, however, a single correction sheet 22 comprises a plurality of masking elements designated generally by the reference character 24 and individually by the reference character 24 together with a suffix contained within parentheses indicating the number of typewritten letters or characters to be masked thereby and, accordingly, the correction sheet 22 may comprise a plurality of masking elements 24 some of which are configured to overlie only a single letter and which are designated 24(1), such as illustrated in FIG. 3 and, some of which may be of sufficient dimensional extent as to simultaneously cover a plurality of typewritten characters, the part of the reference character associated therewith enclosed in parentheses designating the number of typewritten letters or characters to be covered thereby, such as the element 24(3) whose use is illustrated in FIG. 5.

With particular reference to FIG. 6, a single correction sheet 22 may have a plurality of elements 24, most of which, and particularly those illustrated on the lefthand portion of the sheet 22 illustrated in FIG. 6 and designated as 24(1) being of such dimensional extent as to enable coverage of a single typewritten elite or pica character while being of such width as to cover only a single character and not interfere with the adjacent characters in a typewritten line, some of which, such as those generally in the central portion of the sheet 22 illustrated in FIG. 6 and designated as 24(2) may be of a width corresponding to two typewritten characters, some of which such as the second column from the right being of a width corresponding to three characters and designated as 24(3) and some of which, such as the righthand column of the sheet 22 shown in FIG. 6 and designated as 24(4), corresponding to a width equal to four typewritten characters. Additionally, some masking elements 24 may be of extra height, such as those on the lower righthand corner of the sheet 22 shown in FIG. 6 and designated as 24(X) may be of sufficient height for use with characters which extend above or below the usual line position. The correction or masking material in accordance with the present invention may also be produced in roll form.

While the invention has been described, disclosed, illustrated and shown in terms of an embodiment or modification which it has assumed in practice, the scope of the invention should not be deemed to be limited by the precise embodiments or modifications herein described, disclosed, illustrated or shown, such other embodiments or modifications as may be suggested to those having the benefit of the teachings herein being intended to be reserved especially as they fall within the scope and breadth of the claims here appended.

What is claimed is:

1. Correction sheet for obliterating graphic symbols or characters on a flat surface so as to enable the making of changes and corrections thereof comprising, in combination, a pellucid carrier sheet, an opaque film masking element of substantial dimensional extent in all directions so that said masking element is capable of obliterating any of a large number of graphic symbols and characters, said masking element comprising a color and texture similar to the color and texture of the flat surface so as to blend therewith and be substantially non-visible after transferral thereto, means for releasably securing said masking element on the rear face of said carrier sheet so as to enable said masking element to be easily visually and manually positioned by manual manipulation of said carrier sheet to overlie and cover the graphic symbol or character to be obliterated and means for adhering said masking element with said flat surface to enable manually induced transfer of said masking element as a coherent unit from said carrier sheet to said flat surface upon the application of pressure to the front surface of said carrier sheet, as by rubbing thereof with a stick-like object, so that said carrier sheet may be removed to leave said masking element permanently adhered on said flat surface, said correction sheet, particularly for obliterating typewritten material as for the correction of such material even after removal from a typewritter, having said masking element generally rectangular and configured to cover at least a generally rectangular area having a width and height equal, respectively, to the width and height allocated to spacing of a single typewritten character, and wherein said masking element is provided with a letter of contrasting color corresponding in shape and color to a typewritten character to enable obliteration of a typewritten error and correction thereof in a single operation even after removal of the material containing the error from a typewritter and without necessitating that the material be reinserted and re-positioned in a typewriter.

* * * * *